US009278362B2

(12) United States Patent
Wells et al.

(10) Patent No.: US 9,278,362 B2
(45) Date of Patent: Mar. 8, 2016

(54) FRACTAL ORIFICE PLATE

(75) Inventors: William Theo Wells, Metropolis, IL (US); Grant A. Gelven, St. Louis, MO (US)

(73) Assignee: Wells Gelven Fractal Technology, LLC, Metropolis, IL (US)

( * ) Notice: Subject to any disclaimer, the term of this patent is extended or adjusted under 35 U.S.C. 154(b) by 173 days.

(21) Appl. No.: 13/821,978

(22) PCT Filed: Sep. 9, 2011

(86) PCT No.: PCT/US2011/051128

§ 371 (c)(1), (2), (4) Date: May 20, 2013

(87) PCT Pub. No.: WO2012/034106

PCT Pub. Date: Mar. 15, 2012

(65) Prior Publication Data

US 2013/0284830 A1 Oct. 31, 2013

Related U.S. Application Data

(60) Provisional application No. 61/381,425, filed on Sep. 9, 2010.

(51) Int. Cl.

| | |
|---|---|
| ***A62C 31/02*** | (2006.01) |
| ***B05B 1/14*** | (2006.01) |
| *B05B 1/18* | (2006.01) |
| *F02M 21/02* | (2006.01) |

(52) U.S. Cl.

CPC ... *B05B 1/14* (2013.01); *B05B 1/18* (2013.01); *B05B 1/185* (2013.01); *F02M 21/0257* (2013.01)

(58) Field of Classification Search

None

See application file for complete search history.

(56) References Cited

U.S. PATENT DOCUMENTS

| | | | | |
|---|---|---|---|---|
| 4,801,092 | A * | 1/1989 | Webber et al. | 239/418 |
| 5,161,379 | A * | 11/1992 | Jones et al. | 60/740 |
| 5,437,158 | A * | 8/1995 | Fric | 60/739 |
| 5,938,333 | A | 8/1999 | Kearney | |
| 6,333,019 | B1 | 12/2001 | Coppens | |
| 6,616,327 | B1 | 9/2003 | Kearney | |
| 6,742,924 | B2 | 6/2004 | Kearney | |
| 6,802,178 | B2 * | 10/2004 | Sprouse et al. | 60/39.463 |

(Continued)

FOREIGN PATENT DOCUMENTS

| | | | |
|---|---|---|---|
| WO | WO2007/113335 | A2 | 10/2007 |
| WO | WO2009/124939 | A1 | 10/2009 |

OTHER PUBLICATIONS

International Search Report, International Application No. PCT/US2011/051128, mailed Jan. 31, 2012, 8 pages.

(Continued)

*Primary Examiner* — Len Tran
*Assistant Examiner* — Adam J Rogers
(74) *Attorney, Agent, or Firm* — Creati Venture Law, LLC; Dennis JM Donahue, III

(57) ABSTRACT

A conduit with a terminal end, wherein proximate to the terminal end is an orifice plate, wherein the orifice plate has at least one orifice with at least one perimeter, and the at least one perimeter is in a fractal pattern, wherein the conduit can be a nozzle assembly for a flow, wherein examples of a nozzle assembly include a fuel injector, a shower head, a faucet head, and a nozzle head, wherein proximate to the terminal end of each nozzle is the orifice plate with a fractal pattern that provides a downstream spray pattern.

20 Claims, 3 Drawing Sheets

(56) References Cited

U.S. PATENT DOCUMENTS

| | | | | |
|---|---|---|---|---|
| 7,293,402 | B2 * | 11/2007 | Mueller et al. | 60/258 |
| 2004/0227019 | A1 | 11/2004 | Okubo | |
| 2009/0039009 | A1 | 2/2009 | Stolarik | |

OTHER PUBLICATIONS

Aly, A. Abou El-Azm et al., Experimental Study of the Pressure Drop after Fractal-Shaped Orifices in a Turbulent Flow Pipe (vol. 40, pp. 194-197—ISSN 2070-3724), World Academy of Science, Engineering and Technology, Apr. 2008.

Coffey, C. J. et al., Mixing Effectiveness of Fractal Grids for Inline Static Mixers, Imperial College London, Aug. 2007.

Mazzi, B., Vassilicos, J.C., Fractal-Generated Turbulence, J. Fluid Mech. vol. 502, Cambridge University Press, pp. 65-87 (2004).

Soulopoulos, N. et al., A Turbulent Premixed Flame on Fractal-Grid Generated Turbulence [onlline], Cornell University Library cite arXiv:1004.2146v1 [physics.fludyn], Apr. 13, 2010. Retrieved from the internet: <URL: http://arxiv.org/pdf/1004.2146v1.pdf>.

* cited by examiner

FRACTAL ORIFICE PLATE

CROSS-REFERENCE TO RELATED APPLICATIONS

This application claims the benefit of the provisional patent application No. 61/381,425 dated Sep. 9, 2010, which is hereby incorporated by reference.

STATEMENT REGARDING FEDERALLY SPONSORED RESEARCH

Not Applicable.

APPENDIX

Not Applicable.

FIELD OF THE INVENTION

The present invention relates to a patterned orifice plate for fluid atomization. More particularly, the invention relates to orifice plates having at least one orifice in a fractal pattern.

BACKGROUND OF THE INVENTION

Fluid atomization is a key component of many industrial processes. In order to atomize fluid flowing through a pipe one may utilize what is commonly referred to as the Venturi effect, that is, the reduction in fluid pressure that results when a fluid flows through a constricted section of pipe. A common and cost effective device used to create this effect is the orifice plate. A standard single hole orifice causes a pressure drop across the orifice thereby inducing the Venturi effect which then my be used to atomize the fluid. In practice, the degree of atomization is dictated by the magnitude of the pressure drop. A larger pressure drop gives better atomization. Recent studies have indicated that new orifice geometries may be more effective in producing larger pressure changes. Fractal geometries have been studied under steady-state flow conditions but not in an orifice at the terminal end of a pipe.

The standard singular circular orifice has been in place for over a hundred years. This invention introduces a complete geometric shift in orifice design. Here we propose a new design using a self-similar multi-scale pattern of multiple orifice holes. The benefits here are two-fold: The self-similar structure of multiple holes increases the perimeter to area ratio of the effective orifice. This in turn, increases the cross-sectional area of what is referred to as the boundary layer (a phenomenon that exists in any confined viscous fluid flow) which decreases the effective area of the orifice while maintaining the same mean flow velocity. Thus a larger pressure drop is achieved for the same orifice area. On the other hand, the multi-scale design of the orifice will induce a multi-scale turbulent structure in the fluid flow. The increase in turbulent intensity further lowers the downstream pressure which produces a larger pressure differential. Hence, there are two independent physical mechanisms leading to increased pressure drop and thus better atomization.

Orifice plates having a fractal pattern have been used for metering fluid flow. The orifice plates have been used to decrease the turbulence after the orifice plate, as well as provide decreased pressure drop across the orifice plate using a fractal pattern, when compared to a pinhole orifice. There is no suggestion in any of the above-cited references that such metering plates would provide improved atomization of fluid when used at high pressure-drop conditions at the terminus of a conduit.

SUMMARY OF THE INVENTION

The present invention is directed to a conduit with a terminal end, wherein proximate to the terminal end is an orifice plate. The orifice plate has a fractal pattern. The conduit comprises a diameter and said orifice plate is located within three diameter lengths of said terminal end.

In an embodiment, a nozzle assembly for a flow has a conduit for an upstream flow, a terminal end of said conduit for a downstream spray, and an orifice plate proximate to said terminal end. The orifice plate has a fractal pattern.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
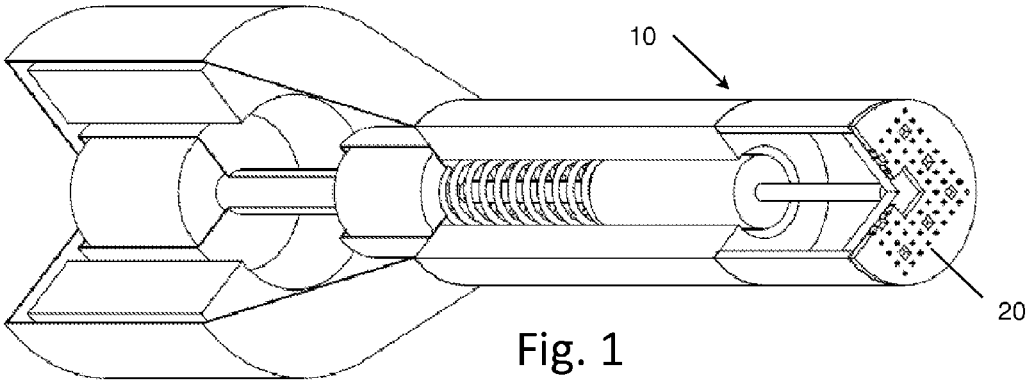
FIG. 1 is a perspective view of a fuel injector with a fractal orifice plate at its terminus.

The essence of the invention is the atomization and metering of fluids by the placement of a fractal pattern orifice (20) at the end of a pipe (30) or other apparatus in order to vary the spray pattern or to meter the fluid. FIG. 1 shows one example of the invention as it would be used in fuel injectors (10) or other orifices for spraying petroleum based or hydrocarbon fuels, e.g., gasoline, diesel fuel, natural gas or propane. In general, this orifice design will be beneficial in any application where a higher degree of fluid atomization, vaporization or control of turbulence is desired without the input of more energy. Simply put, this design is more efficient. Classical single opening orifices have been completely optimized via constraints placed on the physics due to geometry. Thus, a new geometry will be required for further optimization. Fractal geometries offer a solution due to several characteristics: large perimeter to area ratios, scale-invariant self-similarity and non-integer dimension or fractal dimension. Below we provide examples of each.

For classical geometries the fractal dimension, Df, is equal to the topological dimension, so for any classical orifice Df=2. For the fractal geometries considered here we may have $1 \leq Df \leq 2$. It has recently been shown that the pressure drop across a fractal grid is dependent upon fractal dimension. Specifically, for values of $Df<2$ the normalized pressure drop is larger e.g. when Df=1.67 there is approximately a 15% increase. With the application of a fractal orifice to an atomizing nozzle a 15% increase in pressure differential corresponds to a nearly 45% increase in flow velocity making atomization of a fluid nearly twice as effective for the same initial pressure.

Another application of this design utilizes the multi-scale self-similarity to control turbulence from fuel injection in internal combustion engines. When fuel injection occurs, high local levels of turbulence are generated by large velocity gradients in the vicinity of the sprays. Although this direct, spray-generated turbulence is expected to decay rapidly, the surviving turbulence can be transported down the chamber by the mean flow, suggesting the presence of a local source of turbulence production. Distinguishing surviving spray generated turbulence from additional late-cycle turbulence generated by flow structures is difficult but central to the understanding and thus, optimizing of the internal combustion process.

It has been shown using space-filling square fractal grids in wind tunnels that under certain circumstances turbulent decay becomes exponential. Particularly, the principle permanence of large eddies does not hold as integral scales become constant after some critical distance downstream from the grid. Specifically, the Taylor microscale remains constant. Hence, the turbulent intensity decay rate becomes exponential as opposed to the more common power-law. With respect to fuel injection, the fractal orifice may now allow for exponential decay in spray-induced turbulence which would more effectively decouple from late-cycle turbulence.

Figure 2A:
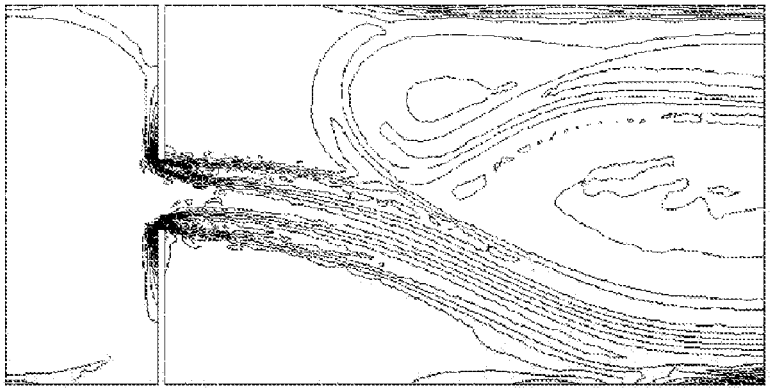
FIG. 2A is an instantaneous vorticity isoplot of a 2-D numerical simulation of a single pinhole orifice.
Figure 2B:
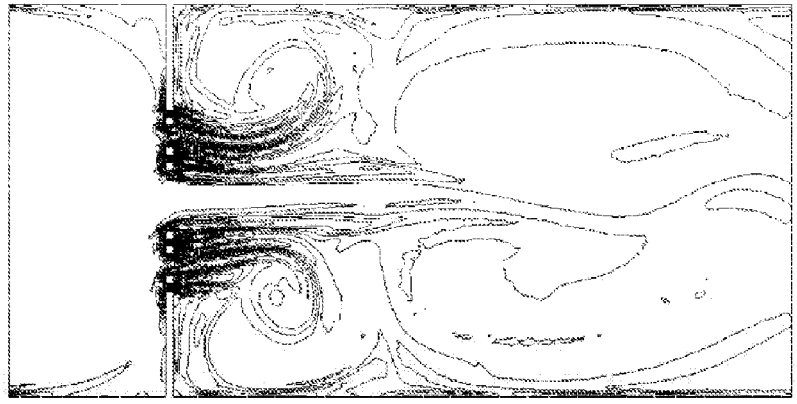
FIG. 2B is an instantaneous vorticity isoplot of a 2-D numerical simulation of a third order Seirpinsky's carpet fractal orifice.

FIGS. 2A and 2B display 2-D numerical simulations of an example comparison between a single pinhole orifice and a $3^{rd}$ order Sierpinsky's carpet fractal orifice, respectively. The voracity isoplots are shown for identical channel configurations and flow conditions at the same time-step. Qualitatively, the pinhole orifice displays anisotropic and inhomogeneous turbulence on large scales leading to unpredictable flow conditions. On the other hand, the fractal orifice displays well defined homogenous vortex formation. In fact, analysis of the full transient simulation reveals periodic vortex shedding which, given certain parametric constraints, decays exponentially.

Yet another application of the fractal design utilizes the large perimeter to area ratio to control the effective orifice area via boundary layer formation to better vaporize liquid. In any confined viscous flow e.g. say flow through an orifice, there are frictional forces between the orifice sidewall and the fluid particles coming in contact with it. To a good approximation, the fluid touching the sidewall will not flow. For any viscous fluid shear stresses exist in the presence of a force. Thus, the fluid close to but not touching the sidewall reacts to the non-moving fluid touching the sidewall creating a velocity gradient in the direction normal to the sidewall. At some point far from the sidewall the shear forces will have diminished significantly so that the fluid velocity is nearly the free stream velocity. This is the point that defines the edge of a region termed the boundary layer. It is a well-established practice that any confined viscous flow may be to a great degree approximated by decomposing the flow into its free stream and boundary layer parts. Provided that the free stream flow is nearly identical for arbitrary confinement geometries we see that flow through an orifice is dictated by the boundary layer itself. The boundary layer is produced via interaction with the confining geometry, specifically, the more surface area coming in contact with the fluid, the more profound the interaction. Thus, a large perimeter to area ratio leads to significant boundary layer formation and so, more control of the orifice flow.

Figure 3:
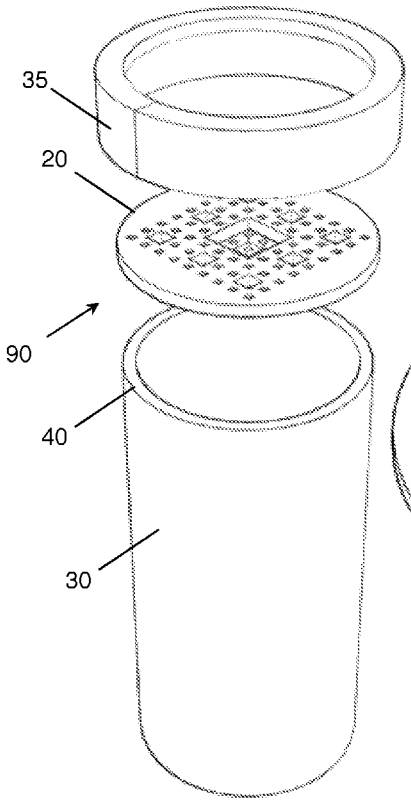
FIG. 3 is a perspective view of a fractal orifice incorporated into a nozzle head.

As an example, consider a single pinhole round orifice plate of unit radius (arbitrary units) with perimeter and area equal to $2\pi$ and $\pi$, respectively. This gives a perimeter to area ratio of 2. Consider then, the $3^{rd}$ order Seirpinsky carpet fractal pattern (25) orifice plate of identical area (FIG. 3). It is easy to show that the corresponding perimeter to area ratio is approximately 16. Nearly an order of magnitude larger for the same orifice plate area. Correspondingly, the effective orifice area will be reduced and a larger pressure drop can be achieved.

In applications where vaporizing liquid is essential without the use of extra power one may use a fractal orifice. In most liquid to vapor phase transitions there is a simple relationship between temperature and pressure. Specifically, the vapor pressure of a liquid is the atmospheric pressure required to condense a vapor to liquid for a given temperature. In general, higher temperatures dictate higher pressures and vice versa. Heating a liquid to vaporization will always require the input of energy. However, if no energy is available for heating, lowering the pressure in a flow is free. In certain applications the use of a fractal orifice will produce as much as a 60% decrease in downstream pressure compared to a single pinhole orifice of equal orifice area. When vaporizing water for example, this corresponds to a nearly 25% reduction in the amount of heat needed to do so.

In an embodiment of the invention, a fractal orifice can be used to atomize fuel. The performance of the fractal orifice is scale-invariant, and the size of the orifice is not limited, but for this embodiment, a fractal orifice may be used in a fuel injection system having a fuel line (conduit) of 1.5 mm. The fractal orifice could be made of a suitable rigid and corrosion-resistant material, such as stainless steel, about 175 microns thick. A third order Seirpinsky carpet pattern can be used that has orifice openings of from 144 microns, to 48 microns to 16 microns. In smaller scale applications, the orifice openings can be as small as in the nanoscale range. In a preferred embodiment, the largest opening is sufficient to allow half of the total flow through the orifice.

Fractal orifices can also be incorporated into residential shower and faucet designs to provide a desired spray pattern. An example of a fractal orifice (20) incorporated into the terminal end (40) of a nozzle head (90) is shown in FIG. 3. The fractal orifice (20) is held in place by a cap (35) which secures it to the terminal end (40) of the conduit (30). The conduit (30) is typically a pipe. In an embodiment, the cap is permanently attached to the fractal orifice (20).

Figure 8:
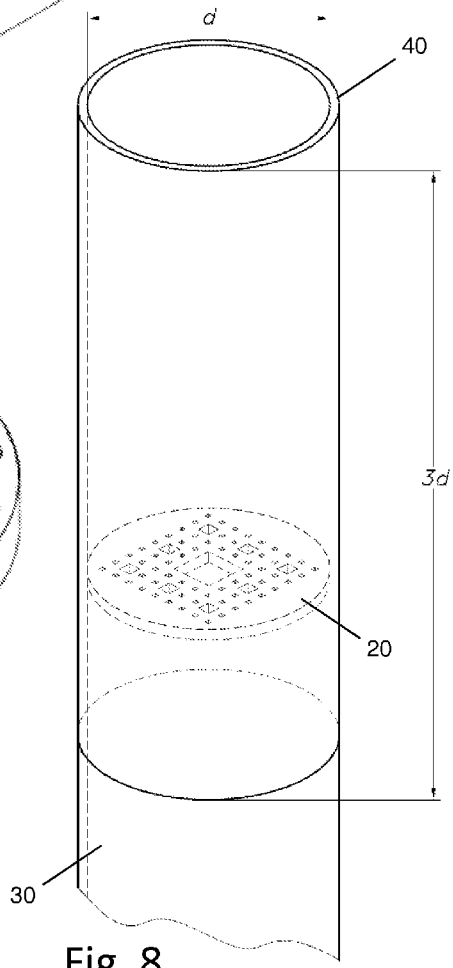
FIG. 8 is a perspective view of a nozzle having the fractal plate within three diameters lengths of the terminal end of the conduit.

FIG. 8 provides an example of a conduit (30) having a terminal end (40) with a diameter length d. The fractal orifice (20), indicated by dotted lines, is inserted inside the conduit (30) within three diameter lengths (3*d*) of the terminal end (40).

Figure 4:
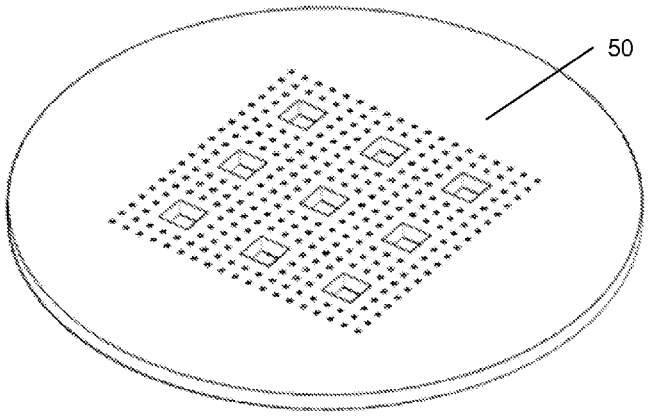
FIG. 4 is a perspective drawing of a compounded Sierpinsky's carpet fractal orifice

As shown in FIG. 4, another use of the fractal orifice is in the covers (50) of outlets of storm sewers and gutters. This application allows for a desired spray pattern of storm-water runoff. Storm-water runoff often washes mud and debris into creeks and ponds, causing pollution and the destruction of native plants and animals. A spray pattern of water run-off would be less likely to erode the soil and carry mud and debris into creeks and bonds. The covers could be used for water flows along roads, parking lots, driveways, golf courses, any place where water accumulates and run off is a consideration.

Figure 5:
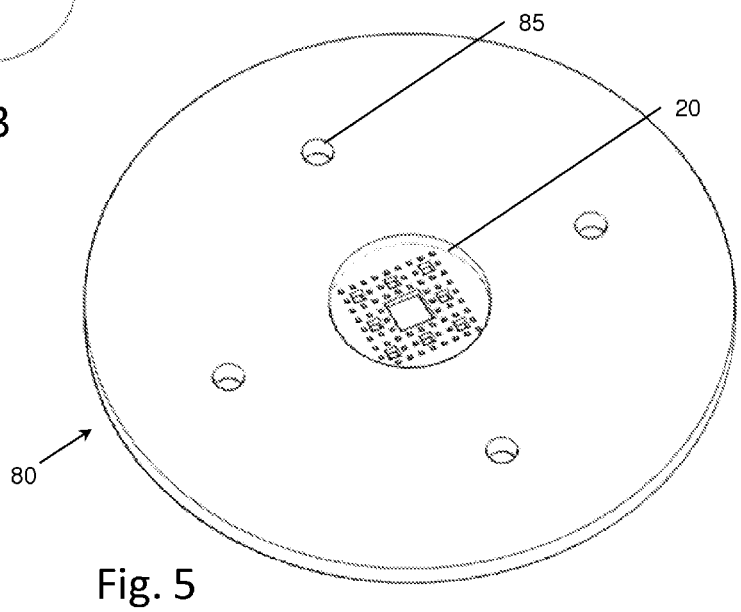
FIG. 5 is a perspective view of a flange that contains a fractal orifice.

The fractal orifice can also be incorporated into a flange (80). An example of a flange that can be used with the fractal orifice plate (20) is shown in FIG. 5. The flange may be secured with bolts through the openings (85). The orifice plate could be used for the inlets of buildings, water systems, sewer systems and/or other situations where a flange would be useful in holding the orifice.

Figure 6:
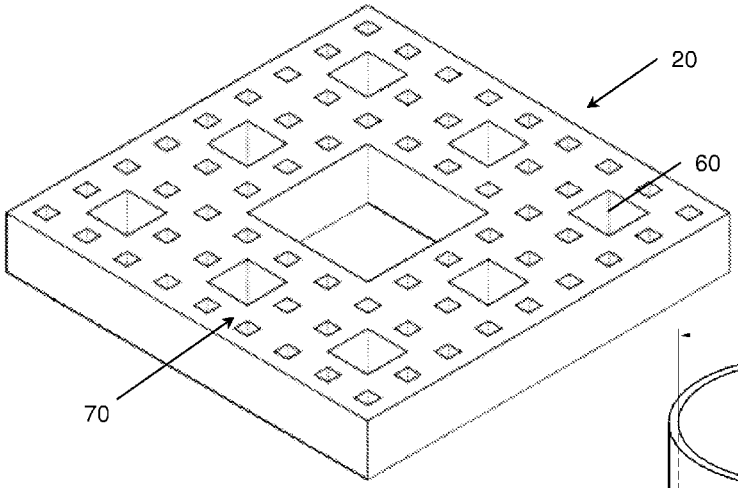
FIG. 6 is a perspective view of a fractal orifice used as a cover for inlets of storm sewers and gutter intakes, e.g., manholes.
Figure 7:
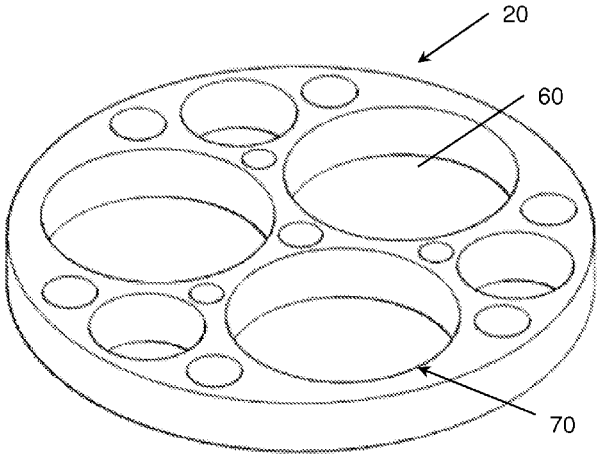
FIG. 7 is an enlarged perspective drawing of an Apollonian net fractal orifice.

FIG. 6 and FIG. 7 are drawings of two orifice plates (20) having at least one orifice (60) which is part of a fractal pattern (70). In FIG. 7, the at least one orifice (60) is an Apollonian net fractal which a self-similar iteration of a geometric shape.

Theoretical flow rates for the orifice with the fractal design of the present invention are provided in the table below. These flow rates have been calculated using a classical first order approximation for the initial estimate.

The method for calculating the volumetric flow-rate of an incompressible, inviscid, laminar fluid flow through a horizontal pipe using an orifice plate is well understood. One may assume a near steady state in order to reduce Bernoulli's equation to a statement of Conservation of Energy. Combining such a statement with a continuity equation yields a simple algebraic expression for the flow-rate in a first order approximation as shown in Equation No. 2 below.

$$Q = C_v A\sqrt{2(P-P')/\rho} \qquad \text{Equation No. 2}$$

In the equation above, Q is the volumetric flow-rate, Cv is the orifice flow coefficient, A is the effective cross-sectional area of the orifice, P is the upstream fluid pressure, P' is the downstream fluid pressure, and is the fluid density. Also, boundary layer effects, viscosity and turbulence have been ignored.

TABLE

| | | Volumetric Flow-Rate (G.P.M.) at Pressure (P.S.I.) after Iteration n | | | | | | | | |
|---|---|---|---|---|---|---|---|---|---|---|
| n | A ($in^2$) | 15 | 17 | 20 | 25 | 30 | 40 | 50 | 75 | 100 |
| 1 | 0.0344 | 0.447 | 1.230 | 1.866 | 2.601 | 3.170 | 4.077 | 4.815 | 6.293 | 7.485 |
| 2 | 0.0383 | 0.497 | 1.367 | 2.074 | 2.890 | 3.523 | 4.530 | 5.350 | 6.993 | 8.317 |
| 3 | 0.0386 | 0.502 | 1.382 | 2.097 | 2.923 | 3.562 | 4.580 | 5.410 | 7.070 | 8.409 |
| 4 | 0.0387 | 0.503 | 1.384 | 2.099 | 2.926 | 3.566 | 4.586 | 5.416 | 7.079 | 8.419 |
| 5 | 0.0388 | 0.503 | 1.384 | 2.100 | 2.927 | 3.567 | 4.586 | 5.417 | 7.080 | 8.421 |

For the table of values above, the dimensions used are a radius of 0.394 inches for of the orifice plate and the fluid is assumed to be water at STP. The downstream pressure is set to 14.696 psi, and the orifice flow coefficient is set to 0.620.

In this simulation of a nozzle, the downstream pressure is assumed to be atmospheric, the fluid is assumed to be water, and the orifice flow coefficient is set to a nominal value. As indicated by the other examples provided above, it is possible for the nozzle exit pressure to be different from atmospheric and the fluid does not need to be water, such as when the fractal pattern orifice is used in a fuel injector.

Additional embodiments of this invention include mounting devices for the orifice plate (20) wherein a threaded rim could be permanently attached to the perimeter of the plate, or the plate could be formed to be permanently attached to the conduit (30) and formed as one unit. Any conduit for an upstream flow having a terminal end of said conduit for a downstream spray with an orifice plate proximate to said terminal end, regardless of how the orifice plate is fixed in place or attached is contemplated in these embodiments.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A nozzle assembly for a flow, comprising:

a conduit for an upstream flow;

a terminal end of said conduit for a downstream spray; and an orifice plate proximate to said terminal end;

wherein said orifice plate comprises a scale-invariant fractal pattern that repeats the same pattern from a first scale to a second scale.

2. The nozzle of claim 1, wherein said conduit comprises a diameter and said orifice plate is located within three diameter lengths of said terminal end, and wherein said conduit is selected from the group consisting of a fuel injector, a shower head, a faucet head, and a nozzle head.

3. The nozzle of claim 1, wherein said fractal pattern is comprised of a self-similar iteration on a geometric shape that includes a plurality of multi-scale iterations of said geometric shape and comprises a first set of holes having a first size and a second set of holes having a second size, wherein said first size is larger than said second size, and wherein an entirety of said upstream flow passes through said first set of holes and said second set of holes to said downstream spray.

4. The nozzle of claim 3, wherein said first set of holes allows a first portion of said upstream flow through said orifice plate, wherein said second set of holes allows a second portion of said upstream flow through said orifice plate, and wherein said first portion is more than twice said second portion.

5. The nozzle of claim 1, wherein the fractal pattern is at least one of a Seirpinsky carpet fractal or an Apollonian net fractal.

6. The nozzle of claim 1, wherein said orifice plate is flat and forms a plane, each of said plurality of holes lying within said plane, and wherein the fractal pattern is a Seirpinsky carpet fractal.

7. The nozzle of claim 1 wherein the conduit is a fuel injector, and the fuel is vaporized or atomized when it exits the fractal orifice.

8. A nozzle assembly for a flow, comprising:

a conduit for an upstream flow, said conduit comprising an end;

an opening at said end, wherein said upstream flow exits said conduit through said opening as a downstream spray; and an orifice plate proximate to said opening, wherein said orifice plate comprises a scale-invariant fractal pattern that repeats the same pattern from a first scale to a second scale, wherein said scale-invariant fractal pattern comprises a first set of holes having a first size and a second set of holes having a second size, wherein said first size is larger than said second size, and wherein an entirety of said upstream flow passes through said first set of holes and said second set of holes to said downstream spray.

9. The nozzle assembly of claim 8, wherein said fractal pattern is comprised of a self-similar iteration on a geometric shape that includes a plurality of multi-scale iterations of said geometric shape.

10. The nozzle assembly of claim 8, wherein said pipe is selected from the group consisting of a fuel injector, a shower head, a faucet head, and a nozzle head, and wherein the fractal pattern is a Seirpinsky carpet fractal.

11. The nozzle assembly of claim 8, wherein the fractal pattern is at least one of a Seirpinsky carpet fractal or an Apollonian net fractal.

12. The nozzle assembly of claim 6, wherein said orifice plate is flat and forms a plane, each of said plurality of holes lying within said plane.

13. The nozzle assembly of claim 8, wherein said first set of holes allows a first portion of said upstream flow through said orifice plate, wherein said second set of holes allows a second portion of said upstream flow through said orifice plate, and wherein said first portion is more than twice said second portion.

14. A nozzle assembly for a flow, comprising:

a conduit for an upstream flow;

a terminal end of said conduit for a downstream flow; and an orifice plate proximate to said terminal end;

wherein the orifice plate comprises a scale-invariant fractal pattern that repeats the same pattern from a first scale to a second scale; and wherein said fractal pattern is comprised of a self-similar iteration on a geometric shape that includes a plurality of multi-scale iterations of said geometric shape.

15. The nozzle assembly of claim 14, wherein the orifice plate is mounted onto the conduit by a cap permanently attached to the plate.

16. The nozzle assembly of claim 14, wherein the orifice plate is permanently mounted directly onto the conduit.

17. The nozzle assembly of claim 14, wherein said scale-invariant fractal pattern comprises a first set of holes having a first size and a second set of holes having a second size, wherein said first size is larger than said second size, and wherein an entirety of said upstream flow passes through said first set of holes and said second set of holes to said downstream flow.

18. The nozzle assembly of claim 17, wherein said conduit comprises a diameter and said orifice plate is located within three diameter lengths of said terminal end.

19. The nozzle assembly of claim 18, wherein said first set of holes allows a first portion of said upstream flow through said orifice plate, wherein said second set of holes allows a second portion of said upstream flow through said orifice plate, and wherein said first portion is more than twice said second portion.

20. The nozzle assembly of claim 19, wherein a smallest set of holes in the fractal pattern is on the scale of nanometers.

* * * * *